United States Patent [19]

Bouglas

[11] Patent Number: 5,076,809

[45] Date of Patent: Dec. 31, 1991

[54] PROCESS TO PIGMENT FLAME-RESISTANT YARN

[75] Inventor: Allan B. Bouglas, Roxburghshire, Scotland

[73] Assignee: British Replin Limited, Scotland

[21] Appl. No.: 545,386

[22] Filed: Jun. 27, 1990

Related U.S. Application Data

[63] Continuation-in-part of Ser. No. 286,969, Dec. 26, 1988, abandoned.

[30] Foreign Application Priority Data

Dec. 23, 1987 [GB] United Kingdom ..... 8729998

[51] Int. Cl.[5] ..... D06B 3/04; D06P 5/00

[52] U.S. Cl. ..... 8/478; 8/151.2; 8/490; 8/925

[58] Field of Search ..... 8/478

[56] References Cited

U.S. PATENT DOCUMENTS 3,223,669 12/1965 Chase et al. ..... 524/28
3,275,400 9/1966 Bonitz et al. ..... 8/513
3,647,735 5/1972 Brodnyan ..... 524/521
4,416,124 11/1983 Godau ..... 68/9
4,501,039 2/1985 Godau ..... 8/151.2

FOREIGN PATENT DOCUMENTS 1035445 7/1966 United Kingdom .

*Primary Examiner*—A. Lionel Clingman
*Attorney, Agent, or Firm*—Krass & Young

[57] ABSTRACT

A fabric consisting of or incorporating a yarn, itself resistant to dyeing, and treated to color the yarn prior to forming the fabric by means of a continuous pigment pad-dyeing or coating process. The yarn is impregnated with a mixture of pigment and a binder and is drawn continuously through a roller nip to remove excess mixture. The yarn is next dried and thereafter wound. By using a continuous pad-dyeing process to treat the yarn prior to forming the fabric, the possibility is realized of increasing the color/color pattern choice for fire-resistant materials which are extremely difficult to dye and widening the choice of coloring process for the more generally used materials with practical and/or economic advantage for specials and/or smaller batches.

6 Claims, 1 Drawing Sheet

PROCESS TO PIGMENT FLAME-RESISTANT YARN

REFERENCE TO RELATED APPLICATION

This is a continuation-in-part application of U.S. application Ser. No. 286,969, filed Dec. 20, 1988, abandoned.

BACKGROUND OF THE INVENTION

1. Field of the Invention

This invention relates to the production of fabrics, including textiles and tufted structures, from yarn.

The invention is particularly concerned with color and/or color pattern in such fabrics, especially, but not exclusively, fire resistant fabrics.

2. Description of the Relevant Prior Art

Generally, in the manufacture of fabrics from one or more yarns, the choice of color and/or color pattern in any fabric is virtually unlimited because many materials from which yarns are spun are capable of being colored by dyeing at any of the stages or conditions from being a simple fiber to a fully constructed fabric. However, some fire-resistant materials such for example are known by the names NOMEX, TEKLAN, LENSING and PBI (polybenzimidazole) are difficult or impossible to dye at any stage. Pigment pad-dyeing of textile fabrics has been proposed, but of course produces only a single color product.

According to the present invention, there is provided a fabric constructed from yarn and displaying in at least a portion of the fabric color other than the natural color of the yarn, the said displayed color being that of pigment padded onto the yarn, the padding of the yarn having been effected prior to the construction of the said fabric by pigment pad-dyeing a continuously moving individual run of the yarn.

Further, according to the present invention, there is provided a yarn having a color other than its natural color, the first mentioned color being that of a pigment padded onto the yarn by pigment pad-dyeing a continuously moving individual run of the yarn.

By using a continuous pigment pad-dyeing process to treat yarn prior to weaving or tufting, the possibility is realized of increasing the color/color pattern choice for fire-resistant materials and widening the choice of coloring processes for the more generally used materials with practical and/or economic advantage for specials and/or smaller batches.

BRIEF DESCRIPTION OF THE DRAWINGS

An embodiment of the invention will now be described, by way of example, with reference to the accompanying drawings in which.

DETAILED DESCRIPTION OF THE PREFERRED EMBODIMENTS

Figures 1, 2:
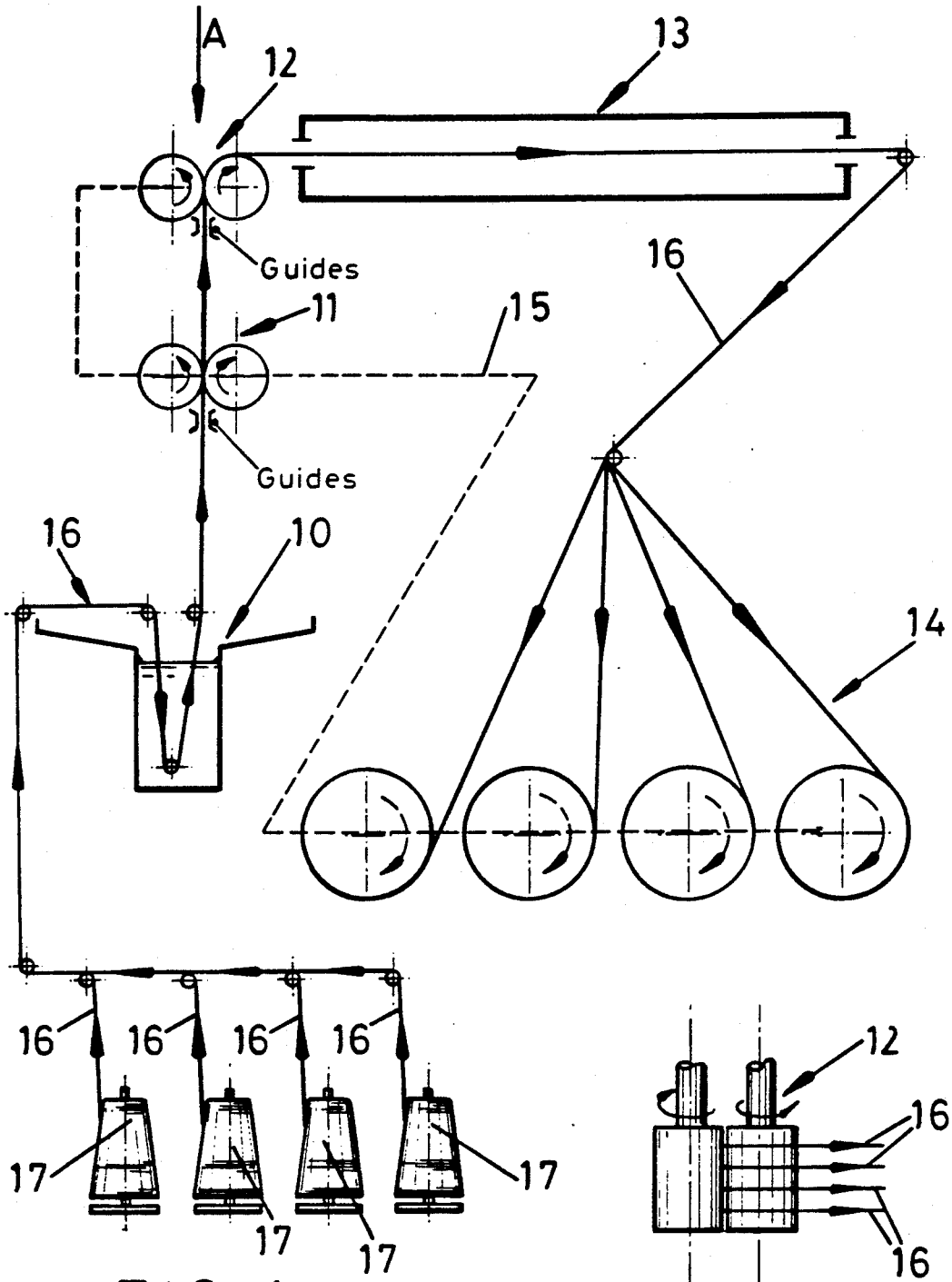
FIG. 1 is a diagrammatical illustration of a process for treating four runs of yarn, in accordance with the present invention.
FIG. 2 is a view in the direction of arrow A in FIG. 1 showing four runs of yarn emerging from a nip between rollers.

In the drawings, apparatus for the continuous pigment pad-dyeing of yarn consists of an impregnation or padding bath 10, sets of synchronously-driven rubber covered rollers 11, 12, drying means 13, and winding means 124 driven synchronously with rollers 11, 12 as indicated by broken line 15, but through slip-clutches (not shown) or the like so that constant tension is maintained in runs of yarn between the rollers 12 and the winding means 14.

More particularly, four mutually independent runs 16 of pre-washed yarn of NOMEX are supplied from reels 17. NOMEX is a fire-resistant yarn spun from a synthetic fiber. The material NOMEX can be dyed, but the dyeing process is expensive and involves the use of dangerous chemicals. The pad bath 10 contains a mixture of a chosen pigment together with a binder and other additives for promoting color migration. A wetting agent may also be included. The consistency of the mixture in the pad bath 10 may best be determined by simple experimentation, but the consistency should be fairly fluid. The nips between the set of roller 11, 12 are adjustable in terms of pressure applied. Optimum settings may be determined by trial and inspection of wetness and color level in the runs of yarn entering the drying means 13. In operation, most of the excess mixture is removed by the roller set 11, and the roller set 12 provides secondary adjustment of the wetness and leveling. Wipers (not shown) may be provided to clear excess mixture from the rollers 11. The drying means 13 is adapted and arranged to fix or stabilize the color in the runs of yarn emerging from the roller set 12 before the runs engage a next guide-pin, roller or winding wheel, and before the yarn is over-laid on a winding wheel. Thus, the drying means 13 is effective to accomplish preliminary drying of the pad-dyed yarn by the time the yarn emerges from the drying means 13. Thereafter, take-up of the yarn runs by the winding means 14 is straight forward and will not affect the levelness of color in the pigment dyed yarn.

The drying means 13 is envisaged as being an elongate tube or duct carrying a flow of warm air. Alternatively, the drying means 13 is an infra-red drying station or a microwave drying station.

EXAMPLES

A preferred pigment color is selected from a commercially available range sold under the name "MINERPRINT®," manufactured by Industrial Chemica Minerva, Milan, Italy. This is a range of predispersed pigments in concentrated paste form which are easily mixed into an appropriate base liquor. The paste contains, in addition to synthetic pigment, both non-ionic and anionic surfactants, and polyglycols; and is mixable or dispersible in water.

Preferred other additives to the pad bath for promoting color levelness and for controlling color migration re, respectively, "MINERPRINT®" surfactants TINTEGAL/N®, and TINTOSTOP®. Both of these additives are produced by the manufacturer mentioned above.

A preferred binder is "MINERPRINT®" Padding Binder FM/N by the manufacturer mentioned above. This binder consists of carboxylated acrylic copolymer aqueous dispersions such as polycarbonate-polymethylmethacrylate dispersions and/or acrylonitrilebutadiene copolymer aqueous dispersions.

Preparation of the pad bath with these materials is in stages, namely: cutting of the binder and additives with water and mixing to provide the base liquor; cutting of the concentrated pigment paste with water; the addition of the cut pigment to the base liquor and mixing; and, finally, filtering of the pigmented liquor (simply to remove foreign particles and/or undesirable agglomerations). The base liquor materials should each be cut with about 3 to 4 times their weights with water; and the concentrated pigment paste should be cut with about 10 to 20 times its weight with water.

The following table gives typically relative quantities of pad-bath ingredients for obtaining pastel, medium and dark shades.

TABLE OF QUANTITIES - PAD BATH

| INGREDIENT | SHADE PASTEL | MEDIUM | DARK |
|---|---|---|---|
| WATER | 912 | 882 | 835 |
| PADDING BINDER FM/N | 55 | 80 | 115 |
| TINTEGAL N | 10 | 10 | 10 |
| TINTOSTOP | 22 | 22 | 25 |
| CONCENTRATED PIGMENT | 1 | 6 | 15 |

IN THE ABOVE TABLE, VALUES INDICATES PART BY WEIGHT PER THOUSAND.

The depth of shade in the finished product is influenced also by setting of the pressure applied by the rollers 11,12. This pressure setting must be determined finally by trial-and-error. The range of typical settings is 350 grams/cm$^2$ to 2500 grams/cm$^2$. The lower values in this range are used for heavier depths of shade, and the higher values in the range are used for lighter depths of shape.

A preferred drying means 13 is a substantially enclosed chamber of length 4 meters and carrying a continuous stream of air at an input temperature of approximately 400° C. and a flow velocity of approximately 8.5 cubic meters per minute.

When a complete batch of yarn has been wound on the winding means 14, the winding wheels are removed to a curing oven in which the temperature is maintained to effect curing of the binder. Thereafter, it is envisaged that the yarn be further treated by the application thereto of a protective coating of a silicone material.

I claim:

1. A fabric constructed from yarn and displaying in at least a portion of the fabric a color other than the natural color of the yarn, the displayed color being that of pigment padded onto the yarn prior to the construction of the said fabric in a continuous pad process.

2. A fabric as claimed in claim 1, wherein the fabric comprises at least two differently colored yarns each pigmented by a separate continuous pad process prior to construction of the fabric.

3. A yarn displaying a color other than its natural color, the displayed color being that of a pigment padded onto the yarn in a continuous pad process.

4. A fabric as claimed in claim 3, made of a flame-resistant material.

5. A method of pigmenting a flame-resistant yarn spun from fibers of a flame-resistant material said method comprising the steps of:

providing a continuous source of said at least one yarn;

providing a pad bath containing a pigment of said one color;

continuously passing said yarn through said pigment pad bath to coat the yarn with the pigment;

subsequently passing said pigment coated yarn through at least one pair of rollers at sufficient pressure so as to squeeze excess pigment from said yarn; and subsequently exposing said squeezed yarn to a drying means to effect drying of the yarn.

6. The method of claim 5 comprising the further steps of:

providing a pad bath comprising: 1 to 15 parts by weight per thousand of a pre-dispersed, concentrated paste pigment; 32 parts by weight per thousand of surfactant; 55–115 parts by weight per thousand of a binder selected from the group consisting essentially of carboxylated acrylic copolymer aqueous dispersion, acrylonitrilebutadiene copolymer aqueous dispersion, and combinations thereof; and the balance water;

providing a pair of rollers set at a pressure of between 350 grams/cm$^2$ and 2500 grams/cm$^2$; and providing a drying source in the form of an airflow at an input temperature of approximately 400° C. and a flow velocity of approximately 8.5 m$^3$/min.

* * * * *

UNITED STATES PATENT AND TRADEMARK OFFICE

CERTIFICATE OF CORRECTION

PATENT NO. : 5,076,809

DATED : December 31, 1991

INVENTOR(S) : Allan B. Bouglas

It is certified that error appears in the above-identified patent and that said Letters Patent is hereby corrected as shown below:

On the title page, Item [63]: Please delete "Dec. 26, 1988" and insert -- Dec. 20, 1988 --.

Column 2, Line 53, Please delete "re," and insert -- are --.

Column 3, Line 41, Please delete "from yarn" and insert from flame resistant yarn --.

Column 4, Line 4, Please delete "differently" and insert -- different --.

Column 4, Line 10, Please delete "fabric" and insert -- yarn --.

Signed and Sealed this

First Day of June, 1993

*Attest:*

Michael K. Kirk

MICHAEL K. KIRK

*Attesting Officer*

*Acting Commissioner of Patents and Trademarks*